US005816728A

United States Patent [19]

Nardolillo et al.

[11] Patent Number: 5,816,728

[45] Date of Patent: Oct. 6, 1998

[54] MASCARA APPLICATOR

[75] Inventors: Irene C. Nardolillo, Northport; Nancy E. Valdes, Oceanside, both of N.Y.

[73] Assignee: Estee Lauder Inc., New York, N.Y.

[21] Appl. No.: 931,445

[22] Filed: Sep. 16, 1997

Related U.S. Application Data

[63] Continuation of Ser. No. 412,661, Mar. 29, 1995, abandoned.

[51] Int. Cl.[6] ..... A45D 40/26; A45D 40/28

[52] U.S. Cl. ..... 401/126; 132/218; 401/128

[58] Field of Search ..... 401/126, 128; 132/218

[56] References Cited

U.S. PATENT DOCUMENTS

| | | | |
|---|---|---|---|
| 1,996,897 | 4/1935 | Blinn | 401/128 X |
| 2,034,416 | 3/1936 | Peat | 401/126 X |
| 3,237,630 | 3/1966 | Politzer | 401/128 X |
| 3,363,635 | 1/1968 | Wurmböck . | |
| 3,896,823 | 7/1975 | Spatz . | |
| 3,908,675 | 9/1975 | Spatz et al. | 401/128 X |
| 3,908,676 | 9/1975 | Levine et al. . | |
| 3,998,235 | 12/1976 | Kingsford . | |
| 4,397,326 | 8/1983 | Formica | 132/218 |
| 4,411,282 | 10/1983 | Wavering . | |
| 4,446,880 | 5/1984 | Gueret et al. . | |
| 4,498,490 | 2/1985 | Siedler . | |
| 4,545,393 | 10/1985 | Gueret et al. . | |
| 4,635,659 | 1/1987 | Spatz . | |
| 4,660,582 | 4/1987 | Taylor . | |
| 5,094,254 | 3/1992 | Krueckel et al. . | |
| 5,197,497 | 3/1993 | Gueret . | |
| 5,332,325 | 7/1994 | Crosnier et al. . | |

FOREIGN PATENT DOCUMENTS

| | | | |
|---|---|---|---|
| 241877 | 8/1946 | Switzerland | 401/128 |

*Primary Examiner*—Steven A. Bratlie
*Attorney, Agent, or Firm*—Pennie & Edmonds LLP

[57] ABSTRACT

A mascara applicator having one or more beads disposed on a central axle extending longitudinally from an elongated rod and handle is disclosed. A first preferred embodiment comprises a single cylindrical bead molded from plastic and having a series of longitudinally spaced grooves along the length of the bead. A second preferred embodiment comprises a plurality of about 5 to 7 beads disposed on a metal axle and retained by means of a flat-headed pin. The beads are capable of individually or collectively rotating about the axle to create optimal mascara application and lash separation. A mascara applicator package utilizing the aforementioned applicator(s) and a housing for storing the applicator and mascara supply is also disclosed.

34 Claims, 1 Drawing Sheet

MASCARA APPLICATOR

This is a continuation of application Ser. No. 08/412,661, filed Mar. 29, 1995,now abandoned.

BACKGROUND OF THE INVENTION

The present invention relates generally to the field of mascara applicators, and in particular to mascara applicators utilizing means other than bristles.

Mascara applicators have traditionally been of the brush-type comprising a multiplicity of bristles mounted to a helically twisted wire, such that the free ends of the bristles are typically disposed in a spiral configuration. The disadvantage associated with use of the aforementioned bristle-type mascara applicators is that of uneven distribution of the mascara to the eyelashes. This problem is caused by the accumulation of mascara on the bristles themselves and within the channels or pockets between the bristles, thereby resulting in excessive mascara being applied to the lashes at the beginning of the application process.

The prior art has attempted to remedy this problem in a number of ways. For example, U.S. Pat. No. 3,908,676 to Levine discloses a mascara applicator having grooves or reservoirs for storing excess mascara adjacent to the bristles. U.S. Pat. No. 5,332,325 to Crosnier incorporates the use of a metering device to expel a predetermined amount of mascara to the applicator. However, such devices are generally complex and therefore relatively expensive to produce in mass quantities.

Alternatively, mascara applicators have been developed which utilize molded teeth (U.S. Pat. No. 3,896,823 to Spatz), a ribbed profile (U.S. Pat. No. 3,363,635 to Wurmbock) or a series of ring-like discs (U.S. Pat. No. 4,411,282 to Wavering) in lieu of the traditional bristle configuration. Similarly, U.S. Pat. No. 5,094,254 to Krueckel discloses a mascara applicator having a reservoir and an applicator surface with a ribbed profile which is capable of exhibiting capillary action. The aforementioned applicators all utilize means which apply mascara by combing it onto the lashes.

Thus, there is a need for an improved mascara applicator which allows for the uniform application of mascara and separation of lashes without the use of a bristled applicator head or other combing mechanism.

SUMMARY OF THE INVENTION

It is an object of the present invention to provide an inexpensive mascara applicator which is simple to use and capable of uniform application of mascara to the eyelashes.

An additional object of the present invention is to provide a mascara applicator which avoids the use of bristles which may be easily poked into the eye and cause eye irritation.

A further object of the present invention is to provide a mascara applicator which is capable of optimal lash separation.

A still further object of the present invention is to provide a mascara applicator which is capable of reaching corner lashes and the delicate lashes of the lower eyelid.

In accordance with the present invention, the foregoing and other objects are achieved by an improved mascara applicator having one or more beads secured to a central axle which extends longitudinally from a rod and handle. The axle is preferably formed from a pin having a flat or rounded head so as to retain the bead or beads on the axle. The axle may be securedly fixed to the rod or alternatively, capable of axial rotation. In an alternative embodiment, a styling tool such as an eyebrow brush or lash separator, is attached to or molded from the end of the axle.

The bead or beads are either hollow or drilled through to accommodate the central axle, and may be manufactured of many known natural or synthetic materials such as wood, glass, metal, stone or plastic. In an alternative embodiment, the bead or beads are manufactured from or coated with a porous material, such as a sponge. The bead or beads utilized may be any number of known shapes, sizes and textures depending on the desired effect.

A first preferred embodiment utilizes a single cylindrically-shaped hollow bead of about 20 millimeters in length and molded from Delron®. The bead preferably contains a series of longitudinally spaced molded grooves or "threading" along the length of the bead at intervals of approximately 0.008 millimeters. Alternatively, the bead contains latitudinally spaced groves. The bead is strung onto a stainless steel flat-headed pin or axle which is then connected to the handle rod at the pointed end of the pin. The bead may be securedly fixed to the pin or axle or alternatively left unsecured, such that the bead is capable of rotating about the axle.

A second preferred embodiment utilizes about 5 to 7 hollow spherical metal beads strung onto a stainless steel flat-headed pin wherein the end opposite the head has been secured to the handle rod. The exterior surface of the beads is preferably textured to contain a plurality of latitudinal grooves. The beads themselves are preferably left unsecured to the metal axle so as to allow for full or partial rotation about the axle. Alternatively, the beads are fixedly secured to the axle. An alternative embodiment utilizes beads of different shapes and sizes disposed on the axle in an alternating configuration.

The mascara applicator(s) described above may be used as part of a package further comprising a container for storing the applicator and mascara supply. The container consists of a cylindrical housing having a threaded neck fitted with an opening for receiving the applicator means and rod. The threaded neck connects with complementary threading on the inside of the applicator handle to close the container.

DETAILED DESCRIPTION OF THE INVENTION

Figure 1:
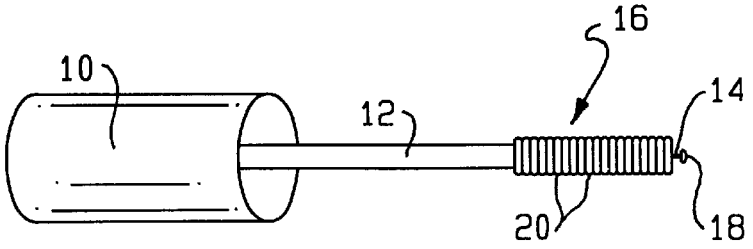
FIG. 1 is a side elevational view of a first embodiment of a mascara applicator according to the present invention.

A mascara applicator of the present invention is shown in FIG. 1. The applicator comprises a handle 10 having a plastic rod or stem 12 extending longitudinally from the handle. A thin pin or wire is secured to the rod 12 at the end opposite the handle 10 and extends longitudinally from the rod to form an axle 14. A single bead or applicator member 16 is strung onto the axle 14 prior to securing the axle 14 to the rod 12. The bead 16 may be fixedly secured to the axle or left unsecured such that the bead 16 freely rotates on axle 14. As shown in FIG. 1, the axle 14 is only partially visible as it extends through the center of bead 16. The pin or wire forming axle 14 is fixedly secured to the rod 12 by any known means such as welding or bonding with epoxy. Alternatively, the axle 14 is connected to the rod 12 such that the axle 14 is capable of rotational movement.

The axle 14 may be straight or curved depending on the particular effect desired. The axle 14 may consist of a thin pin, a twisted wire or a threaded wire depending on the configuration of the bead 16 used. Axle 14 preferably may range from about 7 to 50 millimeters in length and approximately 0.4 to 0.8 millimeters in diameter, although other dimensions may be selected by persons of ordinary skill in the art depending on the particular application. The pin or wire forming axle 14 will preferably be fashioned with a flat or round head 18 or other means for retaining the bead 16 on the axle 14. In a preferred embodiment, head 18 of axle 14 is shaped so as to function as a styling tool, such as a lash separator or combing implement. Possible materials for axle 14 include iron or stainless steel, plastic or plastic-coated metal. In an exemplary embodiment, bead 16 is strung onto a stainless steel flat or round-headed axle 14 which is then bonded with epoxy to the rod 12 at the tail end of the pin 14 such that the bead 16 itself is capable of at least partial rotation about the axle 14. Alternatively, bead 16 is fixedly secured to axle 14 and axle 14 may or may not be capable of rotational movement.

The bead or applicator member 16 may be formed of any natural or synthetic non-porous material such as, wood, stone, metal, glass or plastic. Preferable bead materials include hematite, silver, gold and Delron®, a known moldable plastic. In an alternative embodiment, the bead 16 may also be formed from or covered with a porous material, such as foam or sponge. The bead 16 has been drilled through the center to form a channel to accommodate the axle 14. The bead 16 may be smooth or textured on its exterior surface. In a preferred embodiment, bead 16 is molded from Delron® and contains a series of longitudinally spaced molded grooves 20 or "threading" along the length of the bead at intervals of approximately 0.008 millimeters. In an alternative embodiment, the grooves are latitudinally spaced around the circumference of the bead. The bead is preferably about twenty millimeters in length and approximately 3.0 mm in diameter.

Figure 2:
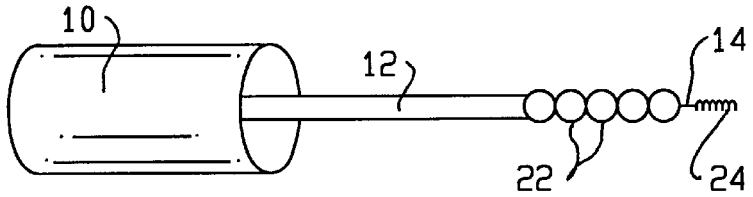
FIG. 2 is a side elevational view of a second embodiment of a mascara applicator according to the present invention.
Figure 3:
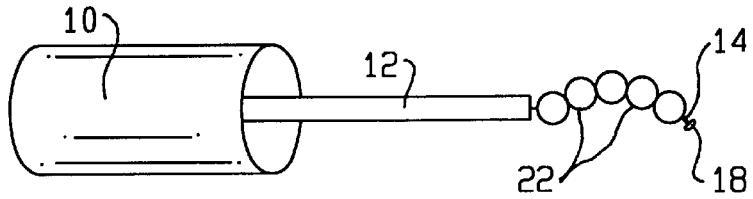
FIG. 3 is a side elevational view of a third embodiment of a mascara applicator according to the present invention.

An alternative embodiment of the present invention is shown in FIG. 2. As described above, the applicator comprises handle 10 having plastic rod or stem 12 extending longitudinally from the handle. Axle 14 is secured to the rod 12 at the end opposite the handle 10 and extends longitudinally from the rod to form axle 14. In the embodiment shown in FIG. 2, the applicator means is comprised of a plurality of spheres or beads 22 which have been drilled or pierced through the center and strung onto axle 14 in the same fashion as described above for the single-beaded embodiment. Preferably, about 5 to 7 beads are utilized. The axle 14 will preferably be fashioned with a head or other means for retaining the beads on the axle. As shown in FIG. 2, the head 24 of axle 14 is preferably shaped so as to function as a styling tool. As shown in FIG. 3, axle 14 may be curved. In both embodiments shown in FIGS. 2 and 3, beads 22 are preferably left unsecured to axle 14 so that beads 22 are capable of individually rotating about axle 14 as contact is made with the eyelashes. Alternatively, beads 22 may be fused together so that they rotate about axle 14 as one unit rather than as individual members. Alternatively, unsecured beads may be interspersed with secured beads so that some beads are capable of rotation while others remain fixed. In those embodiments where axle 14 is capable of rotation, beads 22 may be fixedly secured to axle 14 itself such that beads 22 and axle 14 rotate as one unit. Rotation of beads 22 and/or axle 14 may be 360° or any lesser portion thereof. In those cases where less than full 360° rotation is desired, axle 14 will contain means for halting rotation at the desired position.

These beads 22 may be manufactured of any known natural or synthetic material, such as, wood, stone, metal, glass or plastic. Preferably, beads 22 are manufactured of 14 k gold, glass, hematite or 14 k gold-plated brass. Beads of various shapes and sizes may be utilized depending on the function intended. For example, beads 22 may have a round, oval, square, conical or elliptical cross-section. Preferably the diameter of beads 22 ranges from 0.80 to 7.0 millimeters and the length of the non-spherical beads may range from 0.80 to 9.0 millimeters. Again, other dimensions may be selected by persons of ordinary skill in the art depending on the particular application desired. Smaller beads are preferred for those applicators intended for use on the lower lashes or for reaching the inner corners of the eye.

Figure 4:
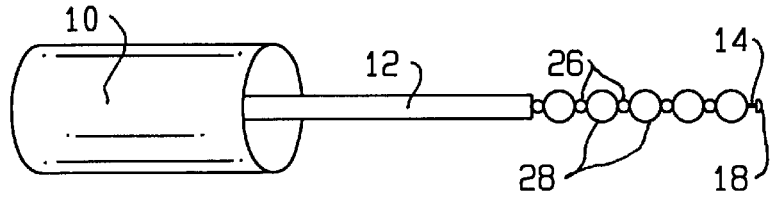
FIG. 4 is a side elevational view of a fourth embodiment of a mascara applicator according to the present invention.

Beads of several different shapes and sizes may also be utilized on the same applicator depending on the desired effect. For example, one may alternate larger beads in the middle portion of the applicator with smaller beads at one or either end of the applicator to conform to the larger and smaller eyelashes found at those portions of the eye. Alternatively, as shown in FIG. 4, beads 26 of one size and shape may be alternated with beads 28 of another size and shape.

In any of the aforementioned embodiments, beads 22 may be hollow or solid and will be drilled or pierced through the center so as to accommodate the central axle 14. The beads 22 may have either a smooth or textured exterior surface. If textured, the bead may contain longitudinal or latitudinal grooves, threading or hammering to facilitate optimal mascara pick up and deposit on the lashes. The textured surfaces are also preferred for those applicators intending to produce greater lash separation.

Figure 5:
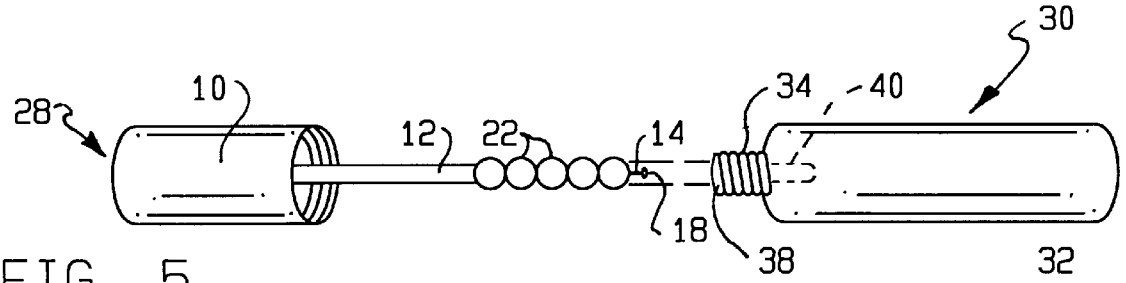
FIG. 5 is a side elevational view of a mascara applicator package according to the present invention.

FIG. 5 shows a mascara applicator package constructed in accordance with the present invention. The applicator package comprises an applicator 29 and a container or housing 30 for storing said applicator and mascara supply. The applicator 29 is designed as described above having a handle 10, a rod 12 extending from said handle 10, an axle 14 extending from said rod 12, and at least one bead 22 (or applicator member 16) disposed on said axle 14. The applicator 29 is stored in a tubular container or housing 30 which contains a reservoir of mascara 32. Housing 30 terminates in threaded neck 34 which contains opening 38 adapted to receive rod 12 and bead(s) 22 therethrough. Neck 34 threadedly receives the interior threads 36 which are conventionally formed on the inside of cap or handle 10 to form a closure for reservoir 32. Preferably a wiper 40 (shown in phantom lines) is retained within neck 34 to remove excess mascara from the applicator as it is extracted from container 30 through opening 38.

The applicator of the present invention heretofore described is intended to be used in the same manner as traditional bristle-type applicators: The applicator is inserted into a container of mascara and retracted through a wiper means to remove excess product. The applicator is then contacted with the eyelashes to apply the mascara to the lashes. However, as described above, in the present invention, the shape of the bead or beads provides optimal application of product to the lashes without the need for the applicator to be manually rotated by the user. The bead rotation further promotes lash separation as the individual lashes are contacted by separate beads or different parts of the same bead which are rotating at different speeds due to the varying diameter of the spheres or the grooved surface.

Therefore, while there have been described what are at present considered to be the preferred embodiments of this invention, it will be obvious to those skilled in the art that various changes and modifications may be made without departing from the invention and it is, therefore, aimed to cover all such changes and modifications that fall within the true spirit and scope of the invention.

What is claimed is:

1. A mascara applicator, comprising:

an elongated rod;

an axle secured to and extending longitudinally from said rod; and means for combing, separating, and coating eyelashes, wherein said means comprises at least one pierced bead disposed on said axle, wherein said at least one bead is adapted to receive and carry mascara for application to eyelashes.

2. A mascara applicator according to claim 1, wherein said axle is fixedly secured to said rod.

3. A mascara applicator according to claim 2, wherein said at least one bead is capable of axial rotation about said axle.

4. A mascara applicator according to claim 3, wherein a single bead is utilized.

5. A mascara applicator according to claim 4, wherein said single bead is a cylindrically-shaped bead.

6. A mascara applicator according to claim 5, wherein said bead further comprises a series of longitudinally spaced, circumferential grooves along the length of said bead.

7. A mascara applicator according to claim 3, wherein said axle further comprises means for retaining said at least one bead on said axle.

8. A mascara applicator according to claim 7, wherein said axle comprises a flat-headed pin.

9. A mascara applicator according to claim 7, wherein said means for retaining said bead or beads further comprises a styling implement.

10. A mascara applicator according to claim 3, wherein said at least one bead is comprised of a nonporous material.

11. A mascara applicator according to claim 10, wherein said at least one bead is comprised of metal or glass.

12. A mascara applicator according to claim 11, wherein said at least one bead is comprised of gold.

13. A mascara applicator according to claim 12, wherein said at least one bead is spherical.

14. A mascara applicator according to claim 13, wherein said at least one bead has a textured exterior surface.

15. A mascara applicator according to claim 14, wherein said at least one bead is grooved.

16. A mascara applicator according to claim 3, wherein a plurality of beads are used.

17. A mascara applicator according to claim 16 wherein said plurality of beads are capable of individual rotation about said axle.

18. A mascara applicator according to claim 17 wherein said axle is curved.

19. A mascara applicator according to claim 17, wherein said plurality of beads comprises first beads having a first size and shape alternately disposed on said axle with second beads having a second size and shape.

20. A mascara applicator, comprising:

a handle;

an axle extending from said handle;

means for combining, separating, and coating eyelashes, wherein said means comprises at least one rotatable member disposed on said axle and rotatable about said axle, wherein said rotatable member is adapted to receive mascara for application to eyelashes; and a housing containing a mascara reservoir and having an opening for receiving said axle and said means for combing. separating. and coating eyelashes therethrough.

21. The mascara applicator according to claim 20, wherein said handle is securable to said housing to form a closure for said reservoir and said opening is surrounded by a wiper matched to said rotatable member to remove excess mascara upon withdrawal from said reservoir.

22. The mascara applicator according to claim 21, wherein a rod member is disposed between said handle and said axle, said rod member having a diameter less than said handle and greater than said axle.

23. The mascara applicator according to claim 21, wherein said at least one rotatable member comprises a single, cylindrical member.

24. The mascara applicator according to claim 21, wherein said at least one rotatable member comprises a plurality of spherical members.

25. A mascara applicator, comprising:

a handle;

an axle extending from said handle; and means for combing, separating and coating eyelashes, wherein said means comprises at least one rotatable member mounted on said axle for rotation thereabout, wherein said member is adapted to receive and carry mascara for application to eyelashes and is rotatable on said axle in response to said member being drawn across a user's eyelashes without user rotation of said handle.

26. A mascara applicator according to claim 25, wherein said at least one rotatable member comprises a single cylindrical member.

27. A mascara applicator according to claim 26, wherein said single cylindrical member further comprises a series of longitudinally spaced, circumferential grooves along the length of said member.

28. A mascara applicator according to claim 25, wherein said axle further comprises means for retaining said at least one rotatable member on said axle.

29. A mascara applicator according to claim 28, wherein said means for retaining said at least one rotatable member further comprises a styling implement.

30. A mascara applicator according to claim 25, wherein said axle is curved.

31. A mascara applicator according to claim 25, wherein said at least one rotatable member is comprised of metal or glass.

32. A mascara applicator according to claim 31, wherein said at least one rotatable member comprises a plurality of spherical members.

33. A mascara applicator according to claim 32, wherein said plurality of spherical members have textured exterior surfaces.

34. A mascara applicator according to claim 25, wherein said at least one rotatable member comprises a plurality of rotatable members, said plurality of rotatable members comprising first rotatable members having a first size and shape alternately disposed on said axle with second rotatable members having a second size and shape.

* * * * *

UNITED STATES PATENT AND TRADEMARK OFFICE

CERTIFICATE OF CORRECTION

PATENT NO. : 5,816,728

DATED : October 6, 1998

INVENTOR(S) : Nardolillo et al.

It is certified that error appears in the above-identified patent and that said Letters Patent is hereby corrected as shown below:

Column 6, line 9, after "combing" delete "." and insert –,–

Column 6, line 9, after "separating" delete "." and insert –,–

Signed and Sealed this

Ninth Day of February, 1999

*Attest:*

*Acting Commissioner of Patents and Trademarks*

*Attesting Officer*